US009721399B2

(12) United States Patent
Ishikawa

(10) Patent No.: US 9,721,399 B2
(45) Date of Patent: Aug. 1, 2017

(54) VEHICLE DIAGNOSING APPARATUS, VEHICLE DIAGNOSING SYSTEM, AND DIAGNOSING METHOD

(75) Inventor: Tomoyasu Ishikawa, Nagoya (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 631 days.

(21) Appl. No.: 12/368,885

(22) Filed: Feb. 10, 2009

(65) Prior Publication Data

US 2009/0216399 A1 Aug. 27, 2009

(30) Foreign Application Priority Data

Feb. 22, 2008 (JP) ..... 2008-041953

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01)

(58) Field of Classification Search
USPC ..... 701/29, 33, 35
See application file for complete search history.

(56) References Cited

U.S. PATENT DOCUMENTS 5,414,645 A * 5/1995 Hirano ..... 702/185
5,572,424 A * 11/1996 Kellogg et al. ..... 701/33.7
5,754,965 A * 5/1998 Hagenbuch ..... 701/32.5
6,216,066 B1 * 4/2001 Goebel et al. ..... 701/31.9
6,668,219 B2 * 12/2003 Hwang et al. ..... 701/29
6,728,612 B1 * 4/2004 Carver et al. ..... 701/33
6,820,038 B1 * 11/2004 Wetzer ..... G06Q 10/08 702/184
6,823,244 B2 * 11/2004 Breed ..... 701/29.7
6,981,176 B2 * 12/2005 Fruehling et al. ..... 714/11
(Continued)

FOREIGN PATENT DOCUMENTS

CN 101004854 A 7/2007
JP 02-031962 A 2/1990
(Continued)

OTHER PUBLICATIONS

Chinese Office Action for corresponding Chinese Patent Application No. 200910008576.1 issued Nov. 29, 2010.

*Primary Examiner* — David E Allred
(74) *Attorney, Agent, or Firm* — Sughrue Mion, PLLC

(57) ABSTRACT

A vehicle diagnosing apparatus, a vehicle diagnosing system, and a diagnosing method enable the determination of completion of a repair or part replacement on a vehicle while adapting to changes in environment and overcoming temporal or spatial restrictions. The vehicle diagnosing apparatus reads diagnostic information from an on-board diagnosing unit on the vehicle that detects an abnormality in an on-board device. A result of a maintenance work performed on the on-board device is finalized by a maintenance result finalizing unit. A determination unit determines the appropriateness of the finalized maintenance work result with reference to determination information stored in a database that is continuously updated. The result of the determination is indicated by a notifying unit. Analogy is used to obtain the diagnostic information when the on-board device requires a long time or a certain condition to provide accurate diagnostic information.

7 Claims, 7 Drawing Sheets

(56) References Cited

U.S. PATENT DOCUMENTS

| | | | | |
|---|---|---|---|---|
| 6,990,404 | B2 * | 1/2006 | Takeuchi | 701/114 |
| 7,103,460 | B1 * | 9/2006 | Breed | 701/32.9 |
| 7,212,911 | B2 * | 5/2007 | Raichle et al. | 701/114 |
| 7,287,195 | B1 * | 10/2007 | Folkesson | 714/44 |
| 7,333,922 | B2 * | 2/2008 | Cannon | 702/193 |
| 7,715,961 | B1 * | 5/2010 | Kargupta | 701/33 |
| 7,801,702 | B2 * | 9/2010 | Berbaum et al. | 702/185 |
| 7,869,908 | B2 * | 1/2011 | Walker | 701/19 |
| 7,917,333 | B2 * | 3/2011 | Grichnik et al. | 702/182 |
| 8,560,160 | B2 * | 10/2013 | Holzer | G05B 19/4184 235/439 |
| 9,563,986 | B2 * | 2/2017 | Cattone | G07C 5/008 |
| 2002/0002430 | A1 * | 1/2002 | Nada | 701/35 |
| 2003/0114965 | A1 * | 6/2003 | Fiechter et al. | 701/29 |
| 2003/0171858 | A1 * | 9/2003 | Kondo | 701/29 |
| 2004/0093137 | A1 * | 5/2004 | Okada | 701/36 |
| 2005/0049768 | A1 * | 3/2005 | Yokochi et al. | 701/36 |
| 2005/0216151 | A1 * | 9/2005 | Gawlik et al. | 701/33 |
| 2005/0273218 | A1 * | 12/2005 | Breed et al. | 701/2 |
| 2006/0212194 | A1 * | 9/2006 | Breed | 701/29 |
| 2007/0005202 | A1 * | 1/2007 | Breed | 701/29 |
| 2007/0271014 | A1 * | 11/2007 | Breed | 701/29 |
| 2007/0276560 | A1 * | 11/2007 | Reichwein et al. | 701/29 |
| 2008/0114502 | A1 * | 5/2008 | Breed et al. | 701/2 |
| 2008/0147265 | A1 * | 6/2008 | Breed | 701/30 |
| 2008/0161989 | A1 * | 7/2008 | Breed | 701/29 |
| 2008/0221751 | A1 * | 9/2008 | Fink et al. | 701/35 |
| 2008/0284575 | A1 * | 11/2008 | Breed | 340/438 |
| 2009/0037044 | A1 * | 2/2009 | Enomoto et al. | 701/33 |
| 2009/0112392 | A1 * | 4/2009 | Buur et al. | 701/29 |
| 2009/0132110 | A1 * | 5/2009 | Fink et al. | 701/33 |
| 2009/0271064 | A1 * | 10/2009 | Enomoto et al. | 701/33 |
| 2009/0281689 | A1 * | 11/2009 | Suganuma et al. | 701/35 |
| 2009/0281690 | A1 * | 11/2009 | Sasaki | 701/35 |
| 2010/0023207 | A1 * | 1/2010 | Maeda et al. | 701/35 |
| 2010/0076642 | A1 * | 3/2010 | Hoffberg et al. | 701/29 |
| 2010/0161175 | A1 * | 6/2010 | Yamada et al. | 701/35 |
| 2010/0205192 | A1 * | 8/2010 | Quadracci | G06F 17/30398 707/758 |
| 2010/0250052 | A1 * | 9/2010 | Ogino | 701/33 |
| 2010/0292892 | A1 * | 11/2010 | Enomoto et al. | 701/35 |
| 2010/0293081 | A1 * | 11/2010 | Liu et al. | 705/34 |
| 2011/0046842 | A1 * | 2/2011 | Smith | 701/33 |
| 2011/0118930 | A1 * | 5/2011 | Hauptmann et al. | 701/29 |
| 2011/0125363 | A1 * | 5/2011 | Blumer et al. | 701/33 |
| 2011/0137489 | A1 * | 6/2011 | Gilleland et al. | 701/2 |
| 2011/0144852 | A1 * | 6/2011 | Kobayashi | 701/29 |
| 2011/0257864 | A1 * | 10/2011 | John et al. | 701/100 |
| 2016/0189114 | A1 * | 6/2016 | Cattone | G06Q 10/087 705/28 |
| 2016/0189115 | A1 * | 6/2016 | Cattone | G06Q 10/20 705/26.8 |
| 2016/0189116 | A1 * | 6/2016 | Cattone | G06Q 10/20 705/27.2 |

FOREIGN PATENT DOCUMENTS

| | | | |
|---|---|---|---|
| JP | 05-180731 | A | 7/1993 |
| JP | 07-281903 | A | 10/1995 |
| JP | 3799795 | B2 | 8/1999 |
| JP | 2003-084998 | A | 3/2003 |
| JP | 2003-212099 | A | 7/2003 |
| JP | 2004-142556 | A | 5/2004 |
| JP | 3849675 | B2 | 2/2005 |
| JP | 2006-025048 | A | 1/2006 |
| JP | 2006-349429 | A | 12/2006 |

* cited by examiner

FIG.3

| DIAGNOSED PART | NORMAL PARAMETER | AFTER-REPAIR PARAMETER | ERROR |
|---|---|---|---|
| SENSOR A | 270 | 300 | SMALL |
| SENSOR B | 20 | 23 | 〃 |
| SENSOR C | 3 | 5 | 〃 |
| ... | ... | ... | ... |
| SYSTEM Q | 111 | 1201 | LARGE |
| ... | ... | ... | ... |

FIG.7

| DIAGNOSED PART | 0sec | 0.5sec | 1.0sec | 1.5sec | 2.0sec | 2.5sec | ··· | 288000 sec (80 HOURS) |
|---|---|---|---|---|---|---|---|---|
| SENSOR A | ? | ? | NORMAL | | | | | |
| SENSOR B | ? | ? | ? | ? | NORMAL | | | |
| SENSOR C | ? | ? | ? | ? | ? | ? | ··· | NORMAL |
| ··· | | | | | | | | |
| SYSTEM Q | ? | ? | ? | ? | ? | ? | | ? |
| ··· | | | | | | | | |

VEHICLE DIAGNOSING APPARATUS, VEHICLE DIAGNOSING SYSTEM, AND DIAGNOSING METHOD

BACKGROUND OF THE INVENTION

1. Field of the Invention

The present invention generally relates to vehicle diagnosing apparatuses, vehicle diagnosing systems, and diagnosing methods for determining the presence or absence of an abnormality in a vehicle.

2. Description of the Related Art

There are some vehicles, such as cars, equipped with a diagnostic device for detecting an abnormality in various on-board sensors or actuators (hereafter referred to as "diagnosed parts"). The diagnostic device monitors the status of the diagnosed parts. Upon detection of an abnormality in a diagnosed part, the diagnostic device may save abnormality information within the device or transmit the abnormality information to a server.

Japanese Patent No. 3799795 discusses a vehicle diagnosing system in which abnormality information is collected by a server. A user may voluntarily bring his or her vehicle with an abnormality into a service shop or the like. Upon elimination of the abnormality in the service shop or the like, "dealt-with" information is transmitted to the server so that an unnecessary transmission of a repair request to the user can be avoided.

After a part causing the abnormality is repaired or replaced, the service shop determines whether the repair or the part replacement is complete based on a result of diagnosis of a diagnosed part using a diagnosing tool (hereafter referred to as "repair completion determination").

FIG. 6 schematically shows a repair completion determination process according to a related art. A repairer R at a service shop removes a defective part from a vehicle 11 (i). The repairer R then attaches an appropriate repair part to the vehicle 11 (ii). The repairer R diagnoses a diagnosed part (which is not necessarily the repair part with which the defective part has been replaced) using a diagnosing tool 15 (iii). The repairer R then confirms a behavior of the vehicle 11 based on his or her experience, or makes sure that the repair is in accordance with a manual or the like (iv). When the vehicle 11 is ascertained as being in a normal condition, the repairer R returns the vehicle 11 to the user U (v).

In such a repair completion determination system which is based on a diagnosed result obtained from the diagnosed part using the diagnosing tool 15, a predetermined determination standard is stored in the diagnosing tool 15, and the diagnosed result is compared with the determination standard. Consequently, it is difficult to ascertain with the diagnosing tool 15 an incident or phenomenon that was not known or expected at the time of drawing up the determination standard stored in the diagnosing tool 15.

For example, a vehicle may be determined as being in a normal condition upon completion of a first repair with the diagnosing tool 15. It is possible, however, that an event or a circumstance that was not considered in the determination standard at the time of the first repair may occur or arise several years after a repair part was attached to the vehicle during the first repair. For example, the upper-limit vehicle speed may be changed by a change in traffic law, or the environment in which the vehicle or the repair part is used may change over time.

The diagnosed result obtained with the diagnosing tool 15 only concerns the individual diagnosed part. Actually, even when the diagnosed result of a particular diagnosed part is normal, whether the repair or part replacement has been normally completed must be comprehensively determined in view of the appropriateness of not just the diagnosed part alone but also other relevant vehicle parts under every possible circumstance.

However, it is not always possible to consider or reproduce such "every possible circumstance" under the available repair conditions that are usually constrained both temporally and spatially. Spending a long time in trying to consider all such possible circumstances may not be realistic from the viewpoint of the vehicle user waiting for the completion of the repair.

FIG. 7 shows a table of diagnosed parts and the time required to diagnose each of them using the diagnosing tool 15. As shown in FIG. 7, it takes 1.0 sec to diagnose a sensor A, and 2.0 sec to diagnose a sensor B. For a sensor C, it takes 80 hours of a continuous run of the vehicle, before an accurate diagnosed result indicating a normality or an abnormality can be acquired. However, the continuous run of 80 hours for a diagnosis is unrealistic. As to a system Q, no diagnosed result is acquired because the system Q requires a high-temperature environment (such as 40° C.) or a low temperature environment (such as minus 30° C.) to acquire an accurate diagnosed result.

If a repair cannot be completed unless such extremely limited environments as mentioned above are reproduced in a service shop or the like, the repair is virtually un-completable.

Thus, in the conventional repair completion determination process, whether a repair or a part replacement has been normally completed is determined directly from a diagnosed result obtained with the diagnosing tool 15. As a result, it has been difficult to make a repair completion determination in which considerations are given to various circumstances of use of the repair part that are not initially assumed, such as an event or an environment change that becomes relevant only a long time afterward.

SUMMARY OF THE INVENTION

It is a general object of the present invention to provide a vehicle diagnosing apparatus, a vehicle diagnosing system, and a diagnosing method whereby one or more of the aforementioned problems are eliminated.

A more specific object of the present invention is to provide a vehicle diagnosing apparatus, a vehicle diagnosing system, and a diagnosing method whereby completion of a repair or a part replacement can be determined while adapting to changes in the environment or reducing temporal or spatial constraints.

According to an aspect of the present invention, a vehicle diagnosing apparatus for detecting an abnormality in a first vehicle includes a maintenance result finalizing unit configured to read diagnostic information from the first vehicle after a maintenance work is performed on an on-board device of the first vehicle, and configured to finalize a result of the maintenance work based on the diagnostic information; a storage unit configured to store determination information for determining an appropriateness of the result of the maintenance work finalized by the maintenance result finalizing unit; a determination unit configured to determine the appropriateness of the finalized result of the maintenance work with reference to the determination information in the storage unit; and a notifying unit configured to provide a notification of a result of the determination made by the determination unit.

In a preferred embodiment, the vehicle diagnosing apparatus further includes a parameter generating unit that generates the determination information based on diagnostic information about the first vehicle and/or diagnostic information about a second vehicle before the maintenance work is performed on the on-board device of the first vehicle.

Thus, the determination information can be adapted to various changes that may occur since when the determination information is initially drawn up. Thus, the appropriateness of the maintenance work on the on-board device, which is determined with reference to the determination information, can be accurately determined.

According to another aspect of the present invention, a vehicle diagnosing system includes a server, an on-board diagnosing unit mounted on a first vehicle or a second vehicle or both, and a vehicle diagnosing apparatus for detecting an abnormality in the first vehicle. The server is configured to receive diagnostic information from the on-board diagnosing unit of the first vehicle and/or the second vehicle. The determination information stored in the storage unit of the vehicle diagnosing apparatus is generated from the diagnostic information about the first vehicle and/or the second vehicle collected in the server.

According to yet another aspect of the present invention, a vehicle diagnosing method for detecting an abnormality in a first on-board device of a first vehicle includes the steps of reading diagnostic information from the first vehicle after a maintenance work is performed on the first on-board device of the first vehicle; finalizing a result of the maintenance work based on the diagnostic information obtained from the first vehicle after the maintenance work; storing determination information for determining an appropriateness of the result of the maintenance work finalized in the finalizing step; determining the appropriateness of the finalized result of the maintenance work with reference to the determination information stored in the storing step; and providing a notification of a result of the determination made in the determination step.

In accordance with a preferred embodiment, the step of generating the determination information includes acquiring diagnostic information from a second on-board device of the first vehicle which diagnostic information is correlated with the diagnostic information about the first on-board device; and estimating the diagnostic information about the first on-board device based on the diagnostic information about the second on-board device.

Thus, the diagnostic information about the first on-board device (diagnosed part) that exhibits accurate diagnostic information only after a long time or under a very limited condition can be estimated from the second on-board device from which accurate diagnostic information correlated with that of the first on-board device can be more readily acquired.

BRIEF DESCRIPTION OF THE DRAWINGS

These and other objects, features and advantages of the invention will be apparent to those skilled in the art from the following detailed description of the invention, when read in conjunction with the accompanying drawings in which:

FIG. 3 shows an example of normal value information;

FIG. 7 shows a table of diagnosed parts diagnosed by a diagnosing tool and the time it takes to diagnose each diagnosed part using the diagnosing tool according to the related art.

DETAILED DESCRIPTION OF THE PREFERRED EMBODIMENTS

Hereafter, preferred embodiments of the present invention are described with reference to the drawings.

Figure 1:
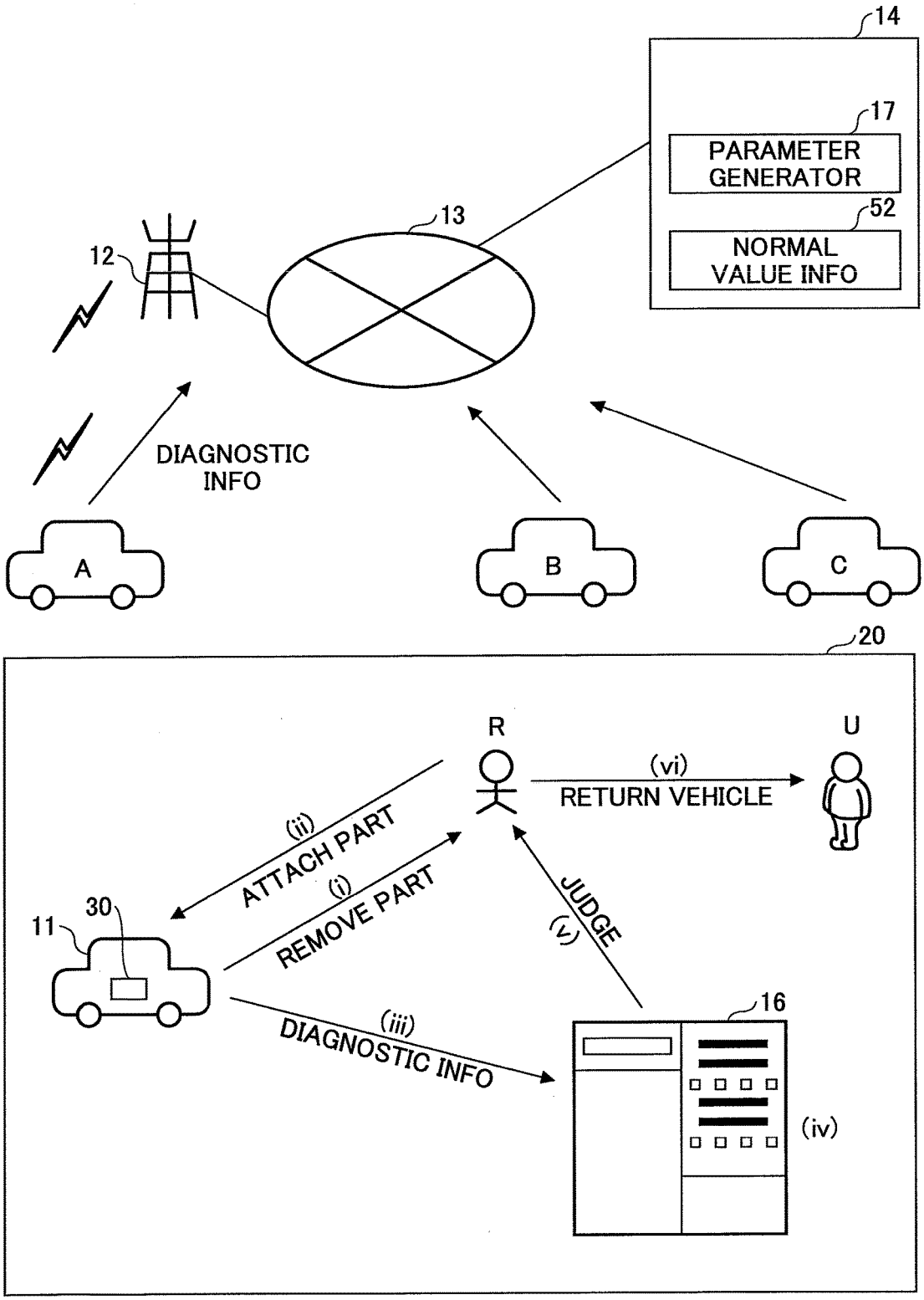
FIG. 1 illustrates how a repair completion determination is made according to an embodiment of the present invention.

FIG. 1 schematically shows how a repair completion determination is made according to an embodiment. In the present embodiment, instead of the aforementioned diagnosing tool 15 according to the related art, a repair result determination apparatus 16 is used to diagnose a vehicle 11. Also, instead of the repairer R, the repair result determination apparatus 16 determines whether a repair is complete.

The repair result determination apparatus 16, which may be installed in a service shop 20, has normal value information stored in advance with reference to which diagnostic information about a diagnosed part may be determined as being normal. By comparing the normal value information and the diagnostic information, it is determined whether the repair has been normally completed. Thus, the temporal or spatial constraints according to the related art under which the determination as to whether a diagnosed result is normal needs to be made can be eliminated.

The normal value information defines a normal range of diagnostic information about each of diagnosed parts. The diagnosed parts may include those for which acquisition of diagnostic information takes a long time, or those for which no diagnosed result can be obtained unless in a certain vehicle status. Thus, a diagnosed result for a diagnosed part can be acquired in the service shop 20 (which may include a service facility of a car dealer), and then whether a repair has been normally completed can be determined in the service shop 20.

If the amount of error between the diagnostic information and the normal value information is within a predetermined value, the repairer R may return the vehicle 11 to a user U. If the error amount is outside the predetermined value, the repairer R can check a predetermined diagnosed part again based on the diagnostic information. Thus, the completion of the repair can be accurately determined.

As shown in FIG. 1, in order to store the normal value information in the repair result determination apparatus 16 in advance, each of various vehicles A through C transmits its own diagnostic information to a server 14 from an on-board diagnosing unit 30 with which each vehicle is equipped. The diagnostic information may indicate a detection of normality and/or that of abnormality of a diagnosed part.

By collecting a large volume of normal diagnostic information, a range of diagnostic information that a diagnosed part would take in a normal state can be defined. By collecting a large volume of abnormal diagnostic information, a range of diagnostic information that a diagnosed part would take in an abnormal state can be defined.

The normal diagnostic information may be periodically transmitted, while the abnormal diagnostic information may be transmitted only upon detection of an abnormality.

The server 14 may be provided by a computer having a central processing unit (CPU). The server 14 includes a parameter generating unit 17 that generates normal value information 52 by conducting data mining on the normal diagnostic information and the abnormal diagnostic information. Data mining refers to the extraction of useful information from a large volume of data, a database, and the like.

The server 14 may transmit the normal value information 52 to the repair result determination apparatus 16 each time the normal value information 52 is updated. The server 14 may also transmit the normal value information to the repair result determination apparatus 16 in response to an inquiry from the service shop 20.

Alternatively, the parameter generating unit 17 may be disposed in the repair result determination apparatus 16, so that the repair result determination apparatus 16 can perform data mining. In this case, the server 14 transmits the normal diagnostic information and the abnormal diagnostic information to the repair result determination apparatus 16 as is.

(On-Board Diagnosing Unit)

Figure 2:
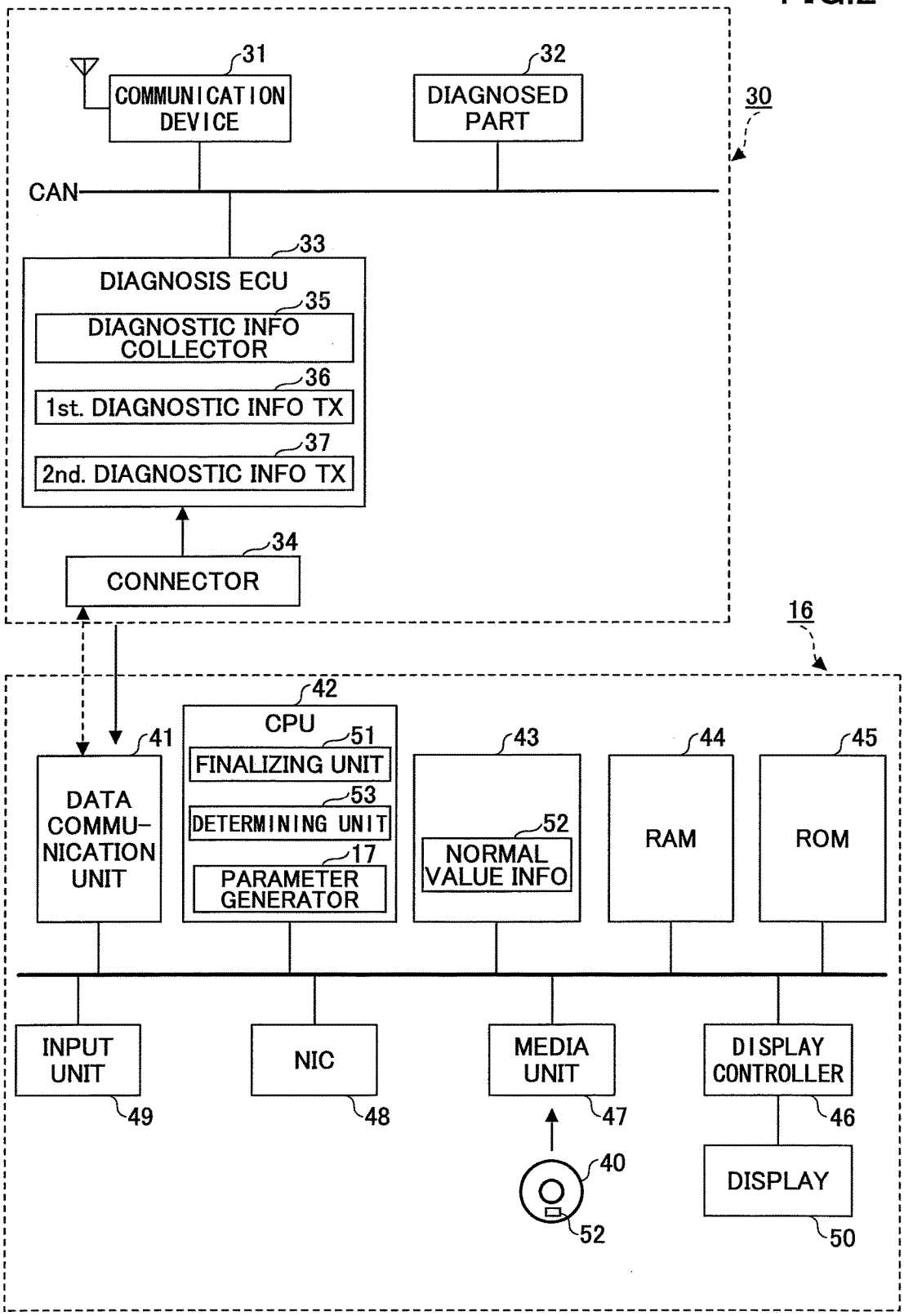
FIG. 2 shows block diagrams of an example of an on-board diagnosing apparatus 30 and a repair result determination apparatus 16.

FIG. 2 shows a block diagram of the on-board diagnosing unit 30 and the repair result determination apparatus 16. The on-board diagnosing unit 30 includes a communication device 31, a diagnosed part 32 (there may be more than one diagnosed part 32), and a diagnostic electronic control unit (ECU) 33, which are connected via a multiplex communication network. The multiplex communication network may be based on a communication protocol such as a controller area network (CAN), a Local Interconnect Network (LIN), and the like. A high-speed CAN may be employed for powertrain-system electronic parts (such as for the engine and brakes). An intermediate-speed CAN may be used for body-system electronic parts (such as for the doors and seats).

The on-board diagnosing unit 30 is controlled by the diagnostic ECU 33. The diagnostic ECU 33 may be a computer including a CPU, a random access memory (RAM), and a read-only memory (ROM). The diagnostic ECU 33 collects diagnostic information about the diagnosed part 32, and transmits the diagnostic information to the server 14 via the communication device 31 or to the repair result determination apparatus 16 via a connector 34.

The on-board diagnosing unit 30 includes a diagnostic information collecting unit 35, a first diagnostic information transmission unit 36, and a second diagnostic information transmission unit 37. The diagnostic information collecting unit 35 may be realized by the CPU of the on-board diagnosing unit 30 executing a program.

The diagnosed part 32 may include one or more sensors or actuators for controlling various onboard devices. The diagnosed part 32 is controlled by another ECU connected to the multiplex communication network. The diagnosed part 32, when connected to the engine ECU, may include an A/F (air-fuel ratio) sensor, a rotation speed sensor, an airflow meter, a water temperature sensor, or a throttle opening sensor. The diagnosed part 32, when connected to the brake ECU, may include a wheel speed sensor, a G sensor, a pump motor, or a hydraulic pressure sensor.

The ECU connected to the diagnosed part 32 has a self-diagnosis function for the sensor or actuator in the diagnosed part 32. When an abnormality is detected, the self-diagnosis function generates diagnostic information indicating a location and nature of the abnormality. The diagnostic information is then stored in the ECU that manages the diagnosed part 32, and/or in the diagnostic ECU 33.

The diagnostic information is information useful for diagnosing the vehicle 11. The diagnostic information may merely indicate the presence or absence of an abnormality, or it may indicate a location and extent of a failure. The diagnostic information may further include operation data before and after the development of the failure, or indicate the date and time when the abnormality arose.

When the diagnosed part 32 has no abnormality (i.e., when it is normal), the diagnostic information collecting unit 35 requests the ECU for the diagnosed part 32 to diagnose the sensors or actuators at predetermined time periods, in order to collect diagnostic information. Such diagnostic information is useful in diagnosing the vehicle 11 as is the diagnostic information indicating the detection of an abnormality.

The diagnostic information collecting unit 35 may perform a statistical processing on the diagnostic information that has been collected at predetermined time periods to extract characteristic information out of the diagnostic information. In this way, the volume of data that needs to be transmitted can be reduced. The statistical processing may involve the calculation of average value s, maximum value s, minimum value s, median value s, and/or a variance of detection signals such as voltage value s or current value s obtained by the sensors or actuators.

Such statistical processing may be performed in either the server 14 or the repair result determination apparatus 16. For example, the parameter generating unit 17 may perform data mining on average value s for vehicles A through C obtained by statistical processing, so that the normal value information 52 for a relevant sensor can be obtained from the diagnostic information at normal time. In accordance with the present embodiment, diagnostic information may or may not be subjected to statistical processing.

The first diagnostic information transmission unit 36 transmits the diagnostic information to the server 14 via the communication device 31. The diagnostic information that is transmitted is associated with information identifying the relevant system of the vehicle 11, such as the engine system, the brake system, or the safety equipment system. The information identifying the vehicle system may include the engine type number and the vehicle number.

Such system identifying information is required because the diagnostic information varies from one vehicle system to another, and data mining needs to be performed on a system by system basis.

The diagnostic information may be transmitted on a vehicle by vehicle basis, so that the normal value information optimized for the individual vehicle 11 can be generated.

The diagnostic information when the diagnosed part 32 is normal may be transmitted either periodically, such as once or more times a day, or irregularly, such as immediately after turning the ignition on or off.

The communication device 31 connects to the network 13 via a base station 12 for a cellular phone network, or an access point of a wireless LAN or a WiMAX (Worldwide Interoperability for Microwave Access), in order to communicate with the server 14.

The transmission of the diagnostic information may be based on a known communication protocol, such as the Point-to-Point protocol (PPP), or the upper-layer Transmission Control Protocol/Internet Protocol (TCP/IP). The network 13 may include a communication network or the Internet.

The connector 34, which may be installed adjacent the instrument panel or the steering column of the vehicle, provides a physical or software interface with the repair result determination apparatus 16. The connector 34 may be in compliance with OBDII (On-Board Diagnostic systems stage II).

(Repair Result Determination Apparatus)

Still referring to FIG. 2, the repair result determination apparatus 16 includes, in addition to the function of the diagnosing tool 15, a repair result finalizing unit 51 and a determination unit 53. The repair result finalizing unit 51 finalizes a repair result. The determination unit 53 determines whether a repair is completed based on the finalized result and the normal value information 52. In the present embodiment, the repair result determination apparatus 16 is described as being an embodiment of a computer, on the assumption that the repair result determination unit 53 is realized by a program.

The repair result determination apparatus 16 includes a CPU 42, a storage unit 43, a RAM 44, a ROM 45, a display control unit 46, a storage medium attachment unit 47, a network interface card (NIC) 48, and an input device 49, which are all connected via a bus. The CPU 42 reads a program stored in the storage unit 43 and executes it using the RAM 44 as a working area, in order to provide the functions of the repair result finalizing unit 51, the determination unit 53, and the parameter generating unit 17. The CPU 42 also controls the repair result determination apparatus 16 comprehensively.

The input device 49 may include a keyboard and mouse, and a voice input device. The input device 49 is used for the input of various operational instructions from a repairer. The storage medium attachment unit 47 reads information stored in a storage medium 40, such as a compact disc (CD), a digital versatile disc (DVD), or a flash memory. The storage medium attachment unit 47 also writes information possessed by the repair result determination apparatus 16 in the storage medium 40. The NIC 48 is a communication device for connection with the network 13. The NIC 48 receives information transmitted by the server 14 in accordance with a predetermined protocol.

In an embodiment where the normal value information 52 is generated in the repair result determination apparatus 16, the normal value information 52 in the storage unit 43 may be updated as needed. In another embodiment where the normal value information 52 is generated by the server 14, the repair result determination apparatus 16 may receive the normal value information 52 from the server 14 via the NIC 48, and updates the normal value information 52 stored in the storage unit 43. Alternatively, the normal value information 52 may be recorded in the storage medium 40 by the server 14, and the storage medium 40 distributed by the server 14 may be read by the repair result determination apparatus 16.

The repair result determination apparatus 16 also includes a data communication unit 41 that can be connected with the connector 34 in the vehicle 11 via radio or wire for communication with the diagnostic ECU 33.

For example, the repairer connects a cable compatible with the standard of the data communication unit 41 to the connector 34, and then operates the input device 49 to request a transmission of diagnostic information from the diagnostic ECU 33. Then, the second diagnostic information transmission unit 37 transmits the diagnostic information collected by the diagnostic information collecting unit 35 to the repair result determination apparatus 16 via the data communication unit 41.

For wireless communication between the repair result determination apparatus 16 and the diagnostic ECU 33, any of various wireless technologies, such as dedicated short range communications (DSRC), Bluetooth, or wireless LAN may be used.

A diagnosis code indicating the diagnosed part 32 with an abnormality may be acquired. However, because in the present embodiment it is determined whether a repair is completed after a repair part is attached, the diagnosis code is in many cases not detected upon acquisition of diagnostic information.

(Normal Value Information)

The normal value information 52 is described. The parameter generating unit 17 in the server 14 generates a parameter value for each diagnosed part 32 that can be considered as being normal, by subjecting the diagnostic information acquired from the vehicles A through C to pattern extraction, classification, regression analysis, etc. For example, a normal value of a detection signal outputted by the diagnosed part 32 of each vehicle is converted into a parameter value. In this way, normal value information 52 for most of the diagnosed parts 32 can be obtained.

If the diagnosed part 32 takes a long time before its diagnostic information can be acquired, one or more diagnosed parts 32 may be determined from which diagnostic information that correlates well with that from the target (time-taking) diagnosed part 32 can be acquired in a short time. Specifically, the one or more correlating diagnosed parts 32 should exhibit diagnostic information that correlates well with the normal-state diagnostic information that the target diagnosed part 32 would exhibit during use of the vehicle (such as when the vehicle ignition is on or an accessory switch alone is on, as well as when the vehicle is running).

The parameter generating unit 17 can then determine a relational expression for determining (estimating) a detection signal from the target diagnosed part 32 from a detection signal from the correlating diagnosed part. Using such relational expression, the parameter generating unit 17 can generate a normal-state parameter value of the target (time-taking) diagnosed part 32.

Similarly, for a diagnosed part 32 from which diagnostic information can be acquired only in a certain running status, one or more diagnosed parts 32 may be determined from which diagnostic information that correlates well with the normal-state diagnostic information that would be detected from the target diagnosed part 32 in the predetermined running status and that can be readily acquired.

The parameter generating unit 17 can then determine a relational expression for determining (estimating) a detection signal from the target diagnosed part 32 based on the detection signal from the correlating diagnosed part. In this way, the parameter generating unit 17 can generate a normal-state parameter value of the target diagnosed part 32 from which the diagnostic information cannot be readily acquired. For such extraction of correlation or determination of the relational expression, data mining may be used.

The parameter value may be generated using the diagnostic information indicating an abnormality. If one or more diagnosed parts 32 that exhibit diagnostic information correlated with the diagnostic information of the diagnosed part 32 that indicates an abnormality can be extracted, this will be effective for the diagnosed part 32 from which the abnormal diagnostic information can be acquired only after a long time or in a certain running status.

Namely, the abnormal-state diagnostic information of the diagnosed part 32 that is only available after a long time or in a certain running status can be determined (estimated) from the diagnostic information of another diagnosed part that is correlated with the diagnostic information for the target diagnosed part 32 and that can be more readily acquired in the service shop 20.

FIG. 3 shows a table including "Normal-state parameter value", which is an example of the normal value information 52. The "Diagnosed part" indicates each diagnosed part 32. The "After-repair parameter value", which is generated from the diagnostic information acquired after a repair, is shown in the column to the right of the normal-state parameter value.

The amount of "Error" may be calculated as follows:

$$\{(\text{Normal-state parameter value}-\text{After-repair parameter value})/\text{Normal-state parameter value}\}\times 100$$

An acceptable value of the error amount may be within several to several dozen percents. The normal-state parameter value may be given a certain margin corresponding to such an acceptable value in advance. Depending on the error amount from the normal-state parameter value, the probability of the presence of an abnormality may be indicated in percentage terms. For example, the error amount of ±20% from the normal-state parameter value may indicate the 0% probability of abnormality; and the error amount of ±20 to 30% may indicate the 10% probability of abnormality.

In the example of FIG. 3, the error amount between the normal-state parameter value and the after-repair parameter value is small for each of the sensors A through C; thus, it is determined that the repair of each of these sensors is normally completed. As to the system Q, the error amount between the normal-state parameter value and the after-repair parameter value is large, so that it is determined that the repair of the system Q may possibly be incomplete. The system Q in FIG. 3 may be the same as the system Q of FIG. 6.

Figure 6:
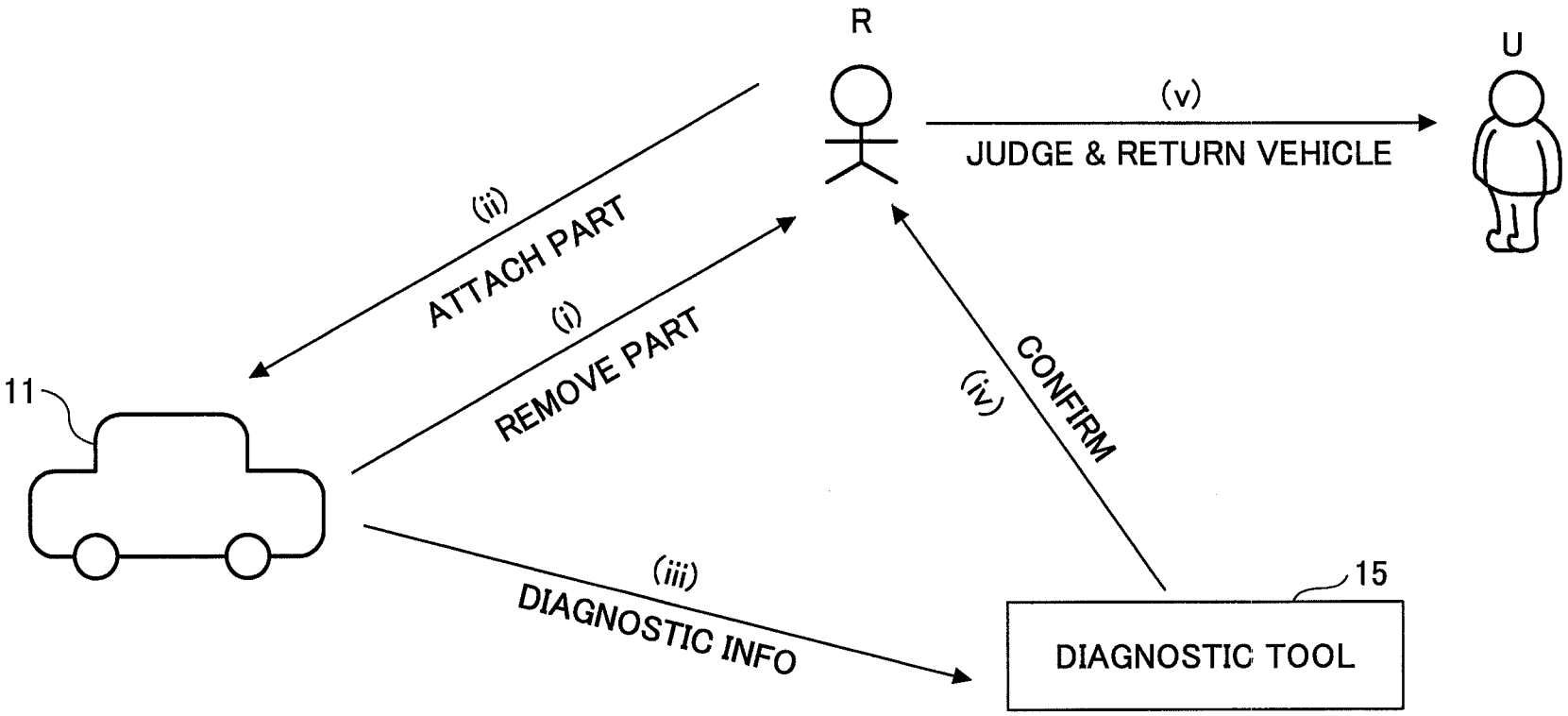
FIG. 6 illustrates a repair completion determination process according to a related art.

Thus, the diagnostic information of the diagnosed part 32 that can only be detected in a certain running status (such as the vehicle speed being greater than zero, or the vehicle running on a highway), such as the system Q of FIG. 6, can be determined in the service shop 20 within a practical time.

Instead of the normal-state parameters being indicated in numerical values as in the example of FIG. 3, a set of the diagnostic information about plural diagnosed parts 32 that correlate with a particular diagnosed part 32 may be clustered into normal and abnormal groups. Then, the diagnostic information of the same set acquired by the data communication unit 41 may be subjected to pattern recognition to determine whether the diagnostic information is classified into the normal or the abnormal group, to thereby determine whether the repair is complete.

(Finalization of Repair Result)

The repair result finalizing unit 51 generates the after-repair parameter value from the diagnostic information read from the vehicle 30, using the same method as used when the parameter generating unit 17 of the server 14 generated the normal-state parameter value. This after-repair parameter value is considered a final result for the repair. The determination unit 53 then determines whether the repair has normally been completed by comparing the normal-state parameter value and the after-repair parameter value.

In another embodiment, the server 14 may include the repair result finalizing unit 51, the determination unit 53, and the normal value information 52. In this embodiment, the diagnostic information received by the data communication unit 41 is transmitted to the server 14, and the repair result determination apparatus 16 receives a determination result from the server 14. In this case, the repair result determination apparatus 16 may be configured in the same way as the conventional diagnosing tool 15 shown in FIG. 16.

(Operational Procedure for the Repair Result Determination Apparatus)

Figure 4:
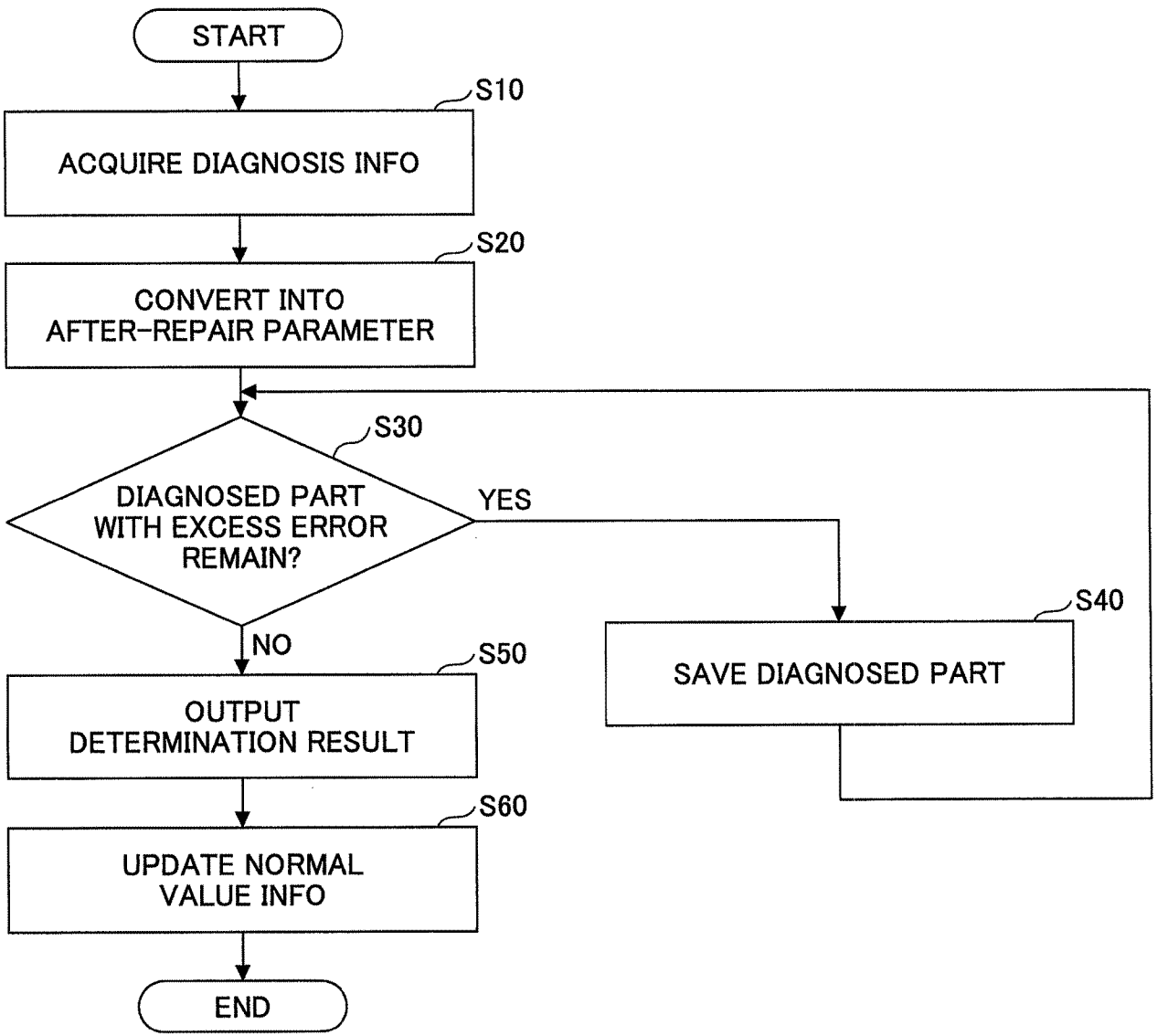
FIG. 4 shows a flowchart of a procedure for determining whether a repair of a vehicle is completed.

FIG. 4 shows a flowchart of a process performed by the repair result determination apparatus 16 in determining whether a repair is completed. The process of FIG. 4 may be started by connecting the data communication unit 41 and the connector 34, and entering a predetermined operation via the input device 49.

The repair result finalizing unit 51 acquires diagnostic information from the on-board diagnosing unit 30 of the vehicle 11 (S10). The diagnostic information has been acquired by the diagnostic ECU 33 requesting the ECU that controls the one or more diagnosed parts 32 to diagnose the sensors or actuators.

Upon acquisition of the diagnostic information from all of the diagnosed parts 32, the repair result finalizing unit 51 converts the diagnostic information into the after-repair parameter value (S20). The determination unit 53 then refers to the normal value information 52 to determine, for each diagnosed part 32, whether the error amount between the normal-state parameter value and the after-repair parameter value exceeds a predetermined value (S30). Alternatively, the determination unit 53 may access the server 14 to refer to the normal value information 52 therein, in order to make the above determination.

If a diagnosed part 32 whose error amount exceeds the predetermined value is detected ("Yes" in S30), the repair result finalizing unit 51 saves information about the diagnosed part 32 in the storage unit 43, or the like (S40). The determination in step S30 is repeated on the remaining diagnosed parts 32.

When there is no more diagnosed part 32 whose error amount exceeds the predetermined value ("No" in S30), the determination unit 53 outputs determination results (S50). The determination results may be displayed on the display 50 in the form of a message. For example, if there was no diagnosed part 32 whose error amount exceeded the predetermined value, the message may read "Repair completed". If there was a diagnosed part 32 whose error amount exceeded the predetermined value, the message may read "Possible incomplete repair: sensor A". The determination results may be stored in the storage unit 43 or the storage medium 40.

The repairer can view such a message and decide to either return the vehicle 11 to the user, repeat the procedure of FIG. 4, or repair the relevant diagnosed part 32.

The parameter generating unit 17 then subjects the normal value information 52 and the after-repair parameter value to data mining, and updates the normal value information 52 (S60). Thus, the normal value information 52 can be updated based on the result of maintenance of the vehicle 11.

Thus, in accordance with the present embodiment, the repair result determination apparatus 16 has the normal value information 52 stored in advance by which the diagnostic information outputted by the diagnosed part 32 in a normal state is defined. And it can be determined whether a repair is completed for a diagnosed part 32 of which the acquisition of diagnostic information takes a long time or requires a certain running status.

In other words, it can be determined, within a realistic time and environment, whether a repair is completed for the diagnosed part 32 that is associated with temporal or spatial restrictions as regards the determination of completion of diagnosis. Even if the environment changes over the years of use, the diagnosed part 32 can be diagnosed in a manner adapted to the change in the environment because of the accumulation of diagnostic information adapted to various environments.

After the completion of a repair is once determined in the service shop 20, the validity of a past repair result can be verified when the vehicle is brought into the service shop 20 subsequently (for the next regular inspection or the mandatory safety inspection).

In another embodiment, when the result of a repair of the diagnosed part 32 is determined by the repair result determination apparatus 16, the determination result may be transmitted to the server 14. In this way, the determination result can be utilized for the subsequent data mining. The determination result may be transmitted to either the server 14 or the repair result determination apparatus 16 where data mining is performed.

Figure 5:
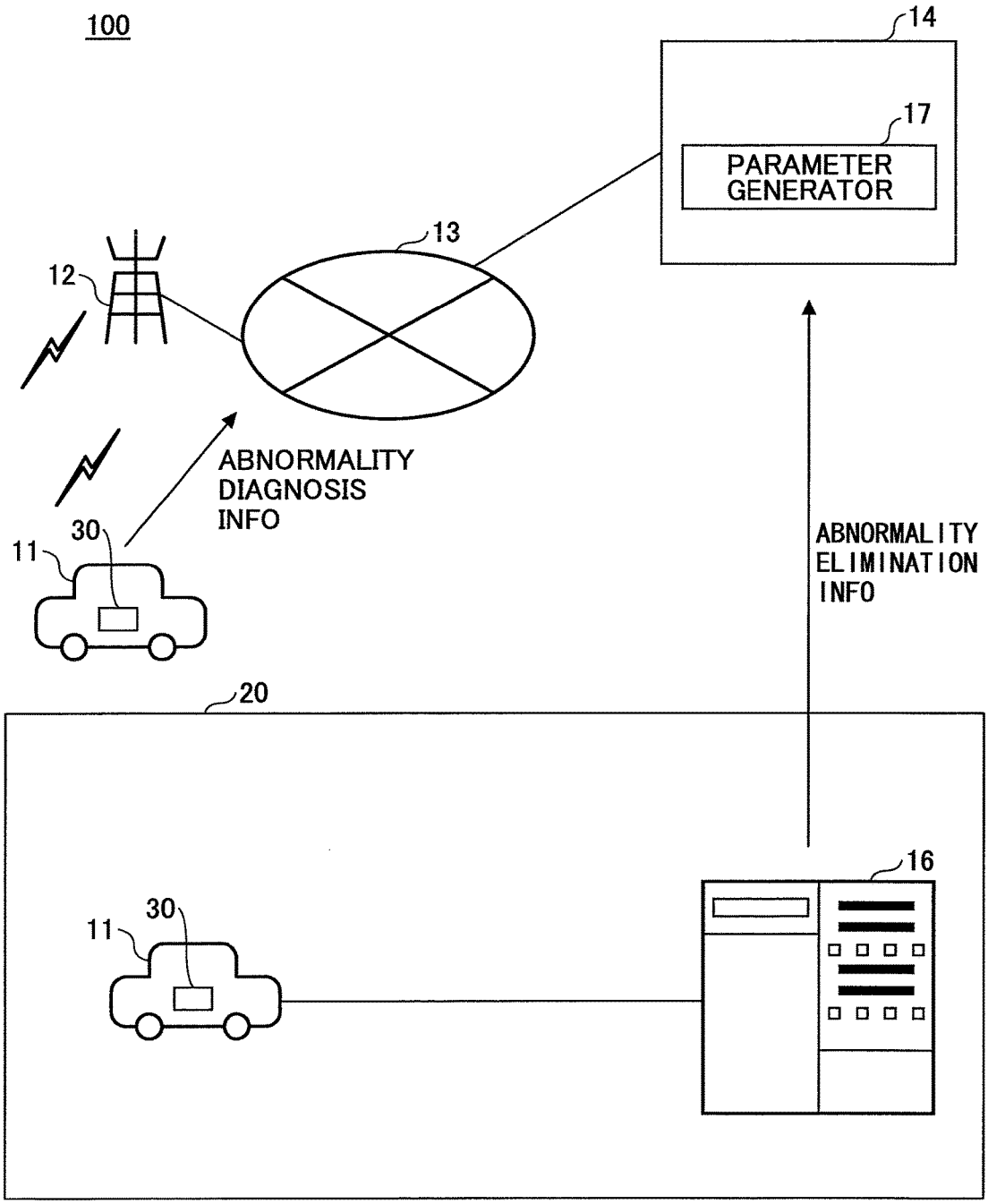
FIG. 5 schematically shows a repair result determination system according to an embodiment of the present invention.

FIG. 5 schematically shows a repair result determination system, in which units or components similar to those shown in FIG. 1 are designated with similar reference numerals and their further description is omitted.

Upon detection of an abnormality in the diagnosed part 32, the on-board diagnosing unit 30 in the vehicle 11 transmits diagnostic information indicating abnormality (to be hereafter referred to as "abnormality diagnosis information") to the server 14. The abnormality diagnosis information may include the vehicle number and the diagnosis code indicating the diagnosed part 32 having the abnormality.

A user of the vehicle 11, noting the abnormality diagnosis information displayed on the instrument panel or the like, may bring the vehicle 11 into the service shop 20. In the service shop 20, the diagnosed part 32 having the abnormality is identified by the repair result determination apparatus 16 based on the diagnosis code or the like, and a repairer replaces the defective component with a repair part.

It is then estimated whether the relevant repair is completed as in the foregoing embodiment. If it is presumed that the repair is complete, the repair result determination apparatus 16 transmits abnormality elimination information to the server 14 via the NIC 48, together with the vehicle number. The abnormality elimination information may also include information about the repair part with which the defective part has been replaced.

The server 14 then collates the abnormality diagnosis information with the abnormality elimination information, and accumulates the information about the repair part necessary for eliminating the abnormality indicated by the abnormality diagnosis information.

Particularly, when a diagnosed part 32 that is different from the diagnosed part 32 indicated by the diagnosis code is replaced with a repair part, the server 14 can perform a more appropriate data mining based on the relationship between the indicated diagnosed part and the replaced diagnosed part. Thus, the server 14 can generate the normal value information 52 so that a replacement part for similar abnormality diagnosis information can be reliably identified.

Thus, in accordance with the present embodiment, the abnormality elimination information is transmitted to the server 14. Thus, in addition to the effects of the foregoing embodiment, the server 14 can generate normal value information 52 more appropriate for the determination of completion of a diagnosis.

While the present invention has been described with reference to specific embodiments, the invention is not limited by such embodiments, and various changes or modifications may occur to those skilled in the art without departing from the scope of the invention.

The present application is based on the Japanese Priority Application No. 2008-041953 filed Feb. 22, 2008, the entire contents of which are hereby incorporated by reference.

What is claimed is:

1. A vehicle diagnosing apparatus including a computer-readable storage medium with an executable program stored thereon for detecting an abnormality in a first vehicle, the apparatus comprising:

a maintenance result finalizing unit configured to read diagnostic information from the first vehicle after a maintenance work is performed on an individual part of the first vehicle, and configured to finalize a result of the maintenance work based on the diagnostic information of the first vehicle after the maintenance work of the individual part;

a storage unit configured to store normal value information for determining an appropriateness of the result of the maintenance work finalized by the maintenance result finalizing unit, wherein the normal value information is based on diagnostic information collected from a plurality of vehicles other than the first vehicle;

a determination unit configured to automatically determine the appropriateness of the finalized result of the maintenance work with reference to the normal value information in the storage unit, by using an iterative process where the individual part or correlating parts are repeatedly checked to assure completeness of a finalized repair to the individual part; and a notifying unit configured to provide a notification of a result of the determination made by the determination unit and a network interface device configured to transmit abnormality elimination information that indicates the abnormality has been eliminated and that is generated from information of the individual part together with vehicle identification information of the first vehicle to a server from which the normal value information was received, wherein the abnormality elimination information includes information that a diagnosed part indicated by a diagnosis code of an abnormality diagnosis information received from the first vehicle before the maintenance work is performed is different from a diagnosed part that is replaced with a repair part, wherein the diagnostic information, which the determination unit uses with reference to the normal value information to determine the appropriateness of the finalized result of the maintenance work for the individual part, includes diagnostic information from a plurality of the correlating parts that exhibit diagnostic information that correlates with normal-state diagnostic information that the individual part would exhibit during use of the vehicle, and wherein the diagnostic information indicates a location and extent of a failure, the individual part is associated with temporal or spatial restrictions in order to determine the appropriateness of the finalized result of the maintenance work for the individual part, and wherein pattern recognition is used to determine whether the diagnostic information is normal or abnormal, wherein the maintenance result finalizing unit saves information about the individual part in the storage unit when an error amount between the normal value information and the diagnostic information exceeds a predetermined threshold and a probability of an abnormity is determined based on the error amount, wherein a set of the diagnostic information for a plurality of the diagnosed parts that correlate with the individual part is gathered into normal and abnormal groups, and the pattern recognition is used to determine whether the diagnostic information of the plurality of the diagnosed parts is classified into the normal group or the abnormal group to determine whether the repair is complete.

2. The vehicle diagnosing apparatus according to claim 1, further comprising a parameter generating unit configured to generate the determination information based on diagnostic information about the first vehicle and/or diagnostic information about a second vehicle before the maintenance work is performed on the on-board device of the first vehicle.

3. A vehicle diagnosing system comprising a computer-readable storage medium with an executable program stored thereon, an on-board diagnosing unit mounted on a first vehicle and/or a second vehicle, and a vehicle diagnosing apparatus for detecting an abnormality of the first vehicle, the vehicle diagnosing apparatus comprising:

a maintenance result finalizing unit configured to read diagnostic information from the on-board diagnosing unit of the first vehicle after a maintenance work is performed on an individual part of the first vehicle, and configured to finalize a result of the maintenance work based on the diagnostic information read from the on-board diagnosing unit of the first vehicle after the maintenance work of the individual part;

a storage unit configured to store normal value information for determining an appropriateness of the result of the maintenance work finalized by the maintenance result finalizing unit, wherein the normal value information is based on diagnostic information collected from a plurality of vehicles other than the first vehicle;

a determination unit configured to automatically determine the appropriateness of the finalized result of the maintenance work with reference to the normal value information in the storage unit, by using an iterative process where the individual part or correlating parts are repeatedly checked to assure completeness of a finalized repair to the individual part; and a notifying unit configured to provide a notification of a result of the determination made by the determination unit, wherein the normal value information stored in the storage unit of the vehicle diagnosing apparatus is generated from the diagnostic information about the first vehicle and/or the second vehicle received in a server; and a network interface device configured to transmit abnormality elimination information that indicates the abnormality has been eliminated and that is generated from information of the individual part together with vehicle identification information of the first vehicle to the server, wherein the abnormality elimination information includes information that a diagnosed part indicated by a diagnosis code of an abnormality diagnosis information received from the first vehicle before the maintenance work is performed is different from a diagnosed part that is replaced with a repair part, wherein the diagnostic information, which the determination unit uses with reference to the normal value information to determine the appropriateness of the finalized result of the maintenance work for the individual part, includes diagnostic information from a plurality of the correlating parts that exhibit diagnostic information that correlates with normal-state diagnostic information that the individual part would exhibit during use of the vehicle, and wherein the diagnostic information indicates a location and extent of a failure, the individual part is associated with the temporal or spatial restrictions in order to determine the appropriateness of the finalized result of the maintenance work for the individual part, and wherein pattern recognition is used to determine whether the diagnostic information is normal or abnormal, wherein the maintenance result finalizing unit saves information about the individual part in the storage unit when an error amount between the normal value information and the diagnostic information exceeds a predetermined threshold and a probability of an abnormity is determined based on the error amount, wherein a set of the diagnostic information for a plurality of the diagnosed parts that correlate with the individual part is gathered into normal and abnormal groups, and the pattern recognition is used to determine whether the diagnostic information of the plurality of the diagnosed parts is classified into the normal group or the abnormal group to determine whether the repair is complete.

4. The vehicle diagnosing system according to claim 3, wherein the server includes a parameter generating unit configured to generate the determination information based on the diagnostic information about the first vehicle and/or the second vehicle received in the server, wherein the determination information generated by the parameter generating unit is sent from the server to the vehicle diagnosing apparatus via a network or a recording medium and is then stored in the storage unit of the vehicle diagnosing apparatus.

5. The vehicle diagnosing system according to claim 3, the vehicle diagnosing apparatus includes a parameter generating unit, wherein the diagnostic information about the first and/or the second vehicle is sent from the server to the vehicle diagnosing apparatus via a network or a recording medium, and wherein the determination information is generated by the parameter generating unit in the vehicle diagnosing apparatus and is then stored in the storage unit of the vehicle diagnosing apparatus.

6. The vehicle diagnosing system according to claim 3, wherein the vehicle diagnosing apparatus sends the result of the determination made by the determination unit to the server when the determination result indicates that the finalized result of the maintenance work is appropriate.

7. A repair result determination apparatus for use in a vehicle repair shop, comprising:

a storage unit including normal-state parameter values for a plurality of parts of a vehicle stored in advance;

a display;

a data communication unit configured to be connected to a vehicle for communication with an on-board diagnosing unit in the vehicle;

a network interface card configured to communicate with a remote server to obtain the normal-state parameter values that are stored in the storage unit;

a processor configured to execute a program stored in the storage unit, wherein the processor is configured to control the repair result determination unit to:

communicate, using the data communication unit, with the on-board diagnosing unit of the vehicle in order to acquire abnormality diagnostic information of a diagnosed part of the vehicle before a maintenance work is performed on the vehicle, wherein the abnormality diagnostic information includes a diagnostic code of the diagnosed part having an abnormality;

acquire diagnostic information from the on-board diagnosing apparatus of the vehicle after the maintenance work is performed on the vehicle;

convert the acquired diagnostic information into an after-repair parameter value;

compare the after-repair parameter value with the normal-state parameter value stored in the storage unit for the diagnosed part, to determine whether the maintenance work of the diagnosed part has been completed, wherein the determination that the maintenance work is complete is based upon an amount of error between the after-repair parameter value and the normal-state parameter value being less than a predetermined threshold value;

display a result of the determination on the display unit to indicate whether or not the maintenance work is complete; and transmit abnormality elimination information, via the network interface card, to the remote server based on the result of the determination of whether the maintenance work is complete for the diagnosed part, wherein the abnormality elimination information includes information that the diagnosed part indicated by the diagnosis code in the abnormality diagnostic information is different than a part that was repaired.

* * * * *